US007708063B2

(12) United States Patent
Palmer

(10) Patent No.: US 7,708,063 B2
(45) Date of Patent: May 4, 2010

(54) CENTRALIZER TOOL, A CENTRALIZING METHOD AND A METHOD OF MAKING A CENTRALIZER TOOL

(75) Inventor: Larry T. Palmer, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 497 days.

(21) Appl. No.: 11/673,069

(22) Filed: Feb. 9, 2007

(65) Prior Publication Data

US 2008/0190602 A1 Aug. 14, 2008

(51) Int. Cl.
*E21B 17/10* (2006.01)

(52) U.S. Cl. ..... 166/241.1; 166/378

(58) Field of Classification Search ..... 166/241.1, 166/241.6, 378, 213; 138/113, 114, 121; 175/325.1
See application file for complete search history.

(56) References Cited

U.S. PATENT DOCUMENTS 4,241,789 A * 12/1980 Grosch ..... 166/241.7
4,834,937 A * 5/1989 Aspden ..... 376/377
5,937,948 A 8/1999 Robbins, III
6,666,267 B1 12/2003 Charlton
6,896,049 B2 5/2005 Moyes

OTHER PUBLICATIONS

Typical Bottomhole Assemblies, [online]; [retrieved Jan. 2, 2007]; retrieved from the Internet http://www.bakerhughes.com/bot/Thru_Tubing/pdf/fs_pg151_161.pdf.

* cited by examiner

*Primary Examiner*—Kenneth Thompson
(74) *Attorney, Agent, or Firm*—Cantor Colburn LLP

(57) ABSTRACT

Disclosed herein is a method for centralizing a downhole component. The method includes, delivering a tubular member with a plurality of lines of weakness therein to a site requiring a centralizer, and actuating the tubular member by causing a portion of the tubular member to deform radially from an unactuated position. The actuated portion contacting a downhole tubular structure, while maintaining at least two separate fluid passages. A first fluid passage between the portion of the tubular member and an outside surface of the tubular member in the unactuated position and a second fluid passage at a dimension smaller than that of the outside surface of the tubular member in the unactuated position.

19 Claims, 5 Drawing Sheets

CENTRALIZER TOOL, A CENTRALIZING METHOD AND A METHOD OF MAKING A CENTRALIZER TOOL

BACKGROUND OF THE INVENTION

Some downhole operations, such as cutting a tubular structure, for example, can be improved by centering a tool within the tubular structure that carries out the operation. Cutters often have a plurality of knives, typically from two to five, that extend radially outwardly (or inwardly depending upon the specific application being cut) to engage the tubular structure being cut. The cutter rotates relative to the tubular structure being cut while the knives extend radially outwardly to thereby engage and cut through the wall of the tubular structure. If the cutter is not centered within the tubular structure the knives can contact and cut through a first portion of the tubular structure sooner than a second portion of the tubular structure that is, for example, diametrically opposite of the first portion. Such a cutting condition can cause excessive vibration, tool damage and an interrupted cut.

Consequently, centralizers are used to center the cutter relative to the tubular structure and thereby provide even engagement of the knives with walls of the tubular structures, which in turn results in a more even cut through the walls with less vibration. Centralizers often employ a plurality of flexible metal springs that engage the inside surface of the tubular structure to center the tool within the tubular structure. Such flexible metal springs however may have inadequate force to center a tool, for example when used in a nonvertically oriented tubular structure resulting in inadequate centering of the tool. Accordingly, there is a need in the art for a centralizer that can center tools regardless of biasing forces acting to urge the tools off center.

BRIEF DESCRIPTION OF THE INVENTION

Disclosed herein is a centralizer. The centralizer includes, a deformable tubular member having, a non-deformable portion with an outside surface defining a reference diameter, a deformable portion having an axis and being deformable to a greater radial dimension than the reference diameter. The greater radial dimension is contactable with a tubular structure within which the deformable tubular member is to be centralized. The deformable portion when in the deformed position has at least one first fluid passage with a greater radial distance from the axis than the reference diameter. The first fluid passage is fluidically isolated from at least one second fluidic passage at a radial dimension from the axis that is smaller than the reference diameter. Further, at least a portion of the deformable portion when deformed is in contact with the tubular structure so that the centralizer is centralized by such contact. The deformable tubular member further has a plurality of lines of weakness, at least one of which is at one of an inside surface and the outside surface and at least one other of the plurality of lines of weakness is at the other of the inside surface and the outside surface. The lines of weakness, upon axial loading of the centralizer cause deformation of the deformable portion and contact of the at least a portion of the deformable portion with the tubular structure.

Disclosed herein is a method for centralizing a downhole component. The method includes, delivering a tubular member with a plurality of lines of weakness therein to a site requiring a centralizer, and actuating the tubular member by causing a portion of the tubular member to deform radially from an unactuated position. The actuated portion contacting a downhole tubular structure, while maintaining at least two separate fluid passages. A first fluid passage between the portion of the tubular member and an outside surface of the tubular member in the unactuated position and a second fluid passage at a dimension smaller than that of the outside surface of the tubular member in the unactuated position.

Further disclosed herein is a method for making a centralizer. The method includes, configuring a deformable tubular member with a plurality of lines of weakness, at least one of the plurality of lines of weakness disposed at each of an inside dimension of the tubular member and an outside dimension of the tubular member. The method further includes, locating the plurality of lines of weakness relative to each other to facilitate deforming of the tubular member in a desired direction upon actuation. And configuring the centralizer tool such that at least a portion is contactable with a downhole structure to which the centralizer tool is centralizable after actuation of the centralizer tool. Additionally, forming at least two fluid passages isolated from one another, a first fluid passage being at a dimension greater than the outside dimension of the tubular member and a second fluid passage being at a dimension smaller than the outside dimension of the tubular member.

Further disclosed herein is a downhole centralizer system. The downhole centralizer system includes, a deformable tubular member with, a non-deformable portion having an outside surface defining a reference diameter, and a deformable portion having an axis and being deformable to a greater radial dimension than the reference diameter. The greater radial dimension is contactable with a tubular structure within which the deformable tubular member is to be centralized. The deformable portion when in the deformed position has a first fluid passage with a greater radial distance from the axis than the reference diameter and is fluidically isolated from a second fluid passage at a radial dimension from the axis that is smaller than the reference diameter. A portion of the deformable portion when deformed is in contact with the tubular structure so that the centralizer is centralized by such contact. The tubular member, also having a plurality of lines of weakness with at least one of the lines of weakness at an inside surface and at least one of the lines of weakness at the outside surface. Additionally, the lines of weakness, upon axial loading of the centralizer causing deformation of the deformable portion and contact of the portion of the deformable portion with the tubular structure. The system further having at least one additional operable component operably attached to the deformable tubular member, the component having operability facilitated by the deformable tubular member.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of several embodiments of the disclosed apparatus and method are presented herein by way of exemplification and not limitation with reference to the Figures.

Figure 1:
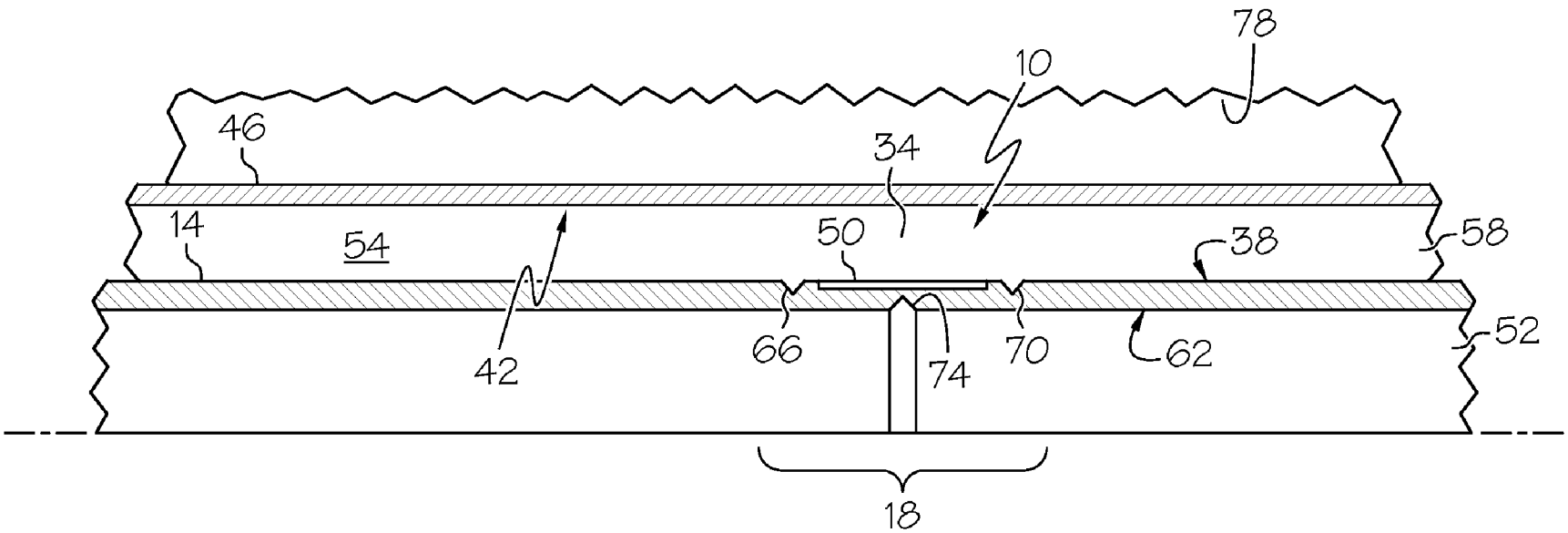
FIG. 1 depicts a partial cross sectional view of a centralizer tool disclosed herein in an unactuated configuration.
Figure 2:
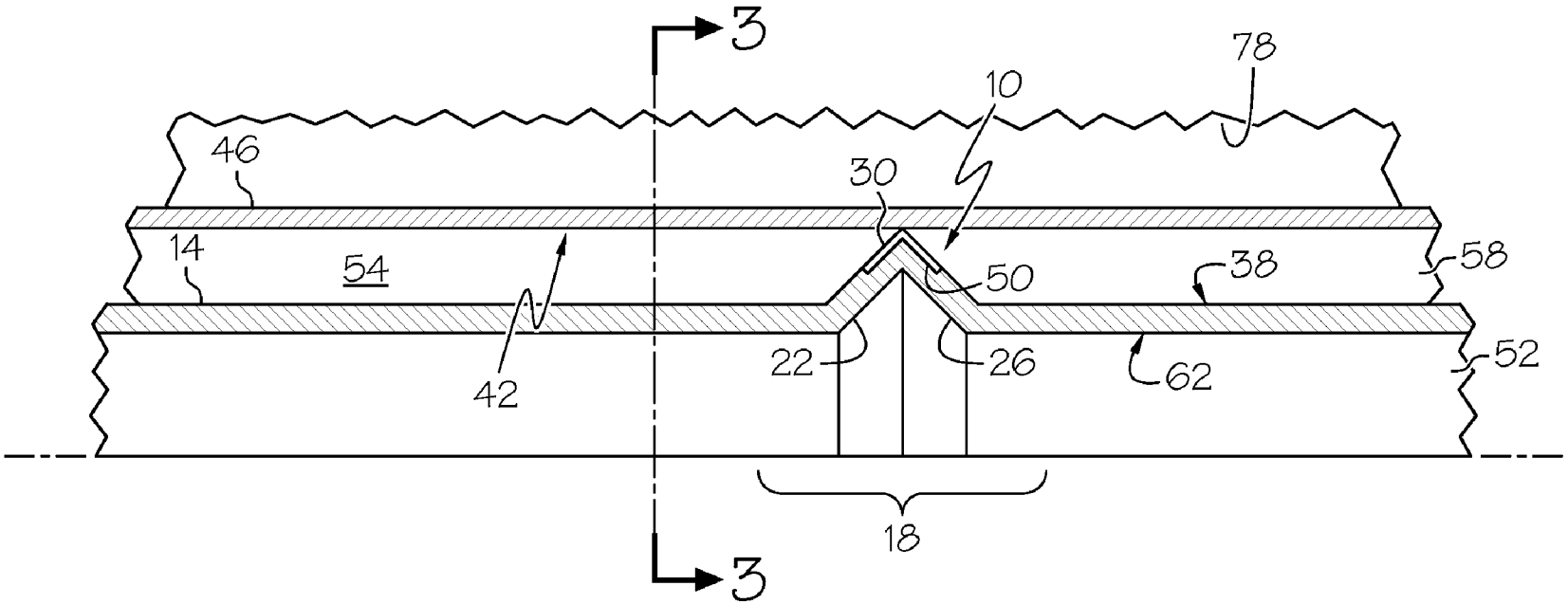
FIG. 2 depicts a partial cross sectional view of the centralizer tool of FIG. 1 in an actuated configuration.

Referring to FIGS. 1 and 2, a partial cross sectional view of an embodiment of the centralizer tool 10 is illustrated. The centralizer 10 includes a tubular member 14 and an actuatable centralizing portion 18. As illustrated in FIG. 1 the centralizing portion 18 is in an unactuated configuration and as illustrated in FIG. 2 the centralizing portion 18 is in an actuated configuration. In the actuated configuration the centralizing portion 18 forms two frustoconical sections 22 and 26. The greatest radial deformation 30 of the tubular member 14 occurs where the two frustoconical sections 22 and 26 meet. Thus, an annular flow area 34 is defined by the greatest radial deformation 30 and an outside surface 38 of the undeformed tubular member 14. The greatest radial deformation 30 contacts an inner surface 42 of a tubular structure 46 within which the centralizer tool 10 is to be centralized and it is this contact that causes the centralizer tool 10 to become centralized within the tubular structure 46. At least one axial groove 50 in the outside surface 38 forms a first fluid passage through which fluid can flow between an uphole annular area 54 and a downhole annular area 58 when the centralizer 10 is in the actuated configuration. A second fluid passage 52 is formed through the center of the tubular member 14 defined by the inside surface 62.

Another operable component (not shown), such as a cutter, for example, can be can be attached to the centralizer tool 10. The cutter can be located either uphole or downhole from the centralizer tool 10, however, the cutter should be located close enough to the centralizer tool 10 that the cutter is centered within the tubular structure 46 by the centralization of the centralizer tool 10. In so doing the centralizer tool 10 locates the cutter central to the tubular structure 46 such that the cutter engages the inner surface 42 substantially simultaneously to prevent detrimental vibrations and interrupted cuts. The centralizing force of the centralizer tool 10 can be controlled by the geometry and materials of the centralizer portion 18 such that noncentering loads encountered will not force the centralizer tool 10 off center.

The tubular member 14 is reconfigurable between the unactuated configuration and the actuated configuration. In the unactuated configuration the frustoconical sections 22 and 26 are configured as cylindrical components having roughly the same inside dimension as the tubular member 14 in the uphole annular area 54 and a downhole annular area 58. Reconfiguration from the unactuated to the actuated configuration is effected, in one embodiment, by the application of an axial compressive load on the tubular member 14. Similarly, reconfiguration from the actuated to the unactuated configuration is effected by the application of an axial tensile load on the tubular member 14.

Reconfigurability of the tubular member 14 between the actuated configuration and the unactuated configuration is due to the construction thereof. The centralizer portion 18 is formed from a section of the tubular member 14 that has three lines of weakness, specifically located both axially of the tubular member 14 and with respect to an inside surface 62 and the outside surface 38 of the tubular member 14. In one embodiment, a first line of weakness 66 and a second line of weakness 70 are defined in this embodiment by diametrical grooves formed in the outside surface 38 of the tubular member 14. A third line of weakness 74 is defined in this embodiment by a diametrical groove formed in the inside surface 62 of the tubular member 14. The three lines of weakness 66, 70 and 74 each encourage local deformation of the tubular member 14 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The three lines of weakness 66, 70 and 74 together encourage deformation of the tubular member 14 in a manner that creates a feature such as the centralizer portion 18. The feature is created, then, upon the application of an axially directed mechanical compression of the tubular member 14 such that the centralizer portion 18 is actuated as the tubular member 14 is compressed to a shorter overall length. Other mechanisms can alternatively be employed to actuate the tubular member 14 between the unactuated relatively cylindrical configuration and the actuated configuration presenting the frustoconical sections 22 and 26. For example, the tubular member may be reconfigured to the actuated configuration by diametrically pressurizing the tubular member 14 about the inside surface 62 in the centralizer portion 18.

Figure 3:
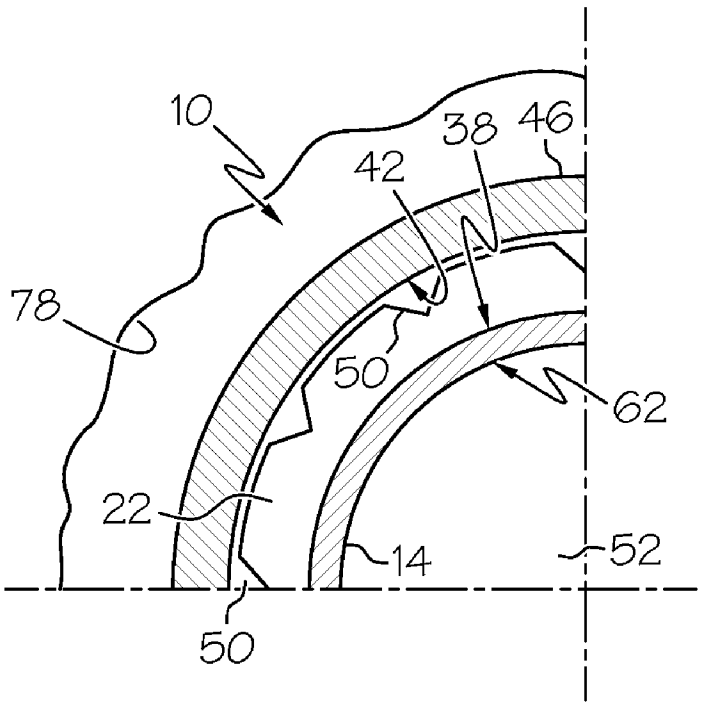
FIG. 3 depicts a partial cross sectional view of the centralizer tool of FIG. 2 taken at arrows 3-3.

Referring to FIG. 3, a cross sectional view of the centralizer tool 10 of FIG. 2 is shown taken at arrows 3-3. The fluid passages between the centralizer tool 10 and the inside surface 42, of the tubular structure 46, created by the axial grooves 50, is illustrated. Although the axial grooves 50 are illustrated herein as V-shaped, it should be appreciated that alternate embodiments can have grooves of any shape. It should also be noted that in alternate embodiments the centralizer tool 10 could be used to center within an open bore 78 or any other tubular structure having a relatively consistent measurement to its axis.

Figure 4:
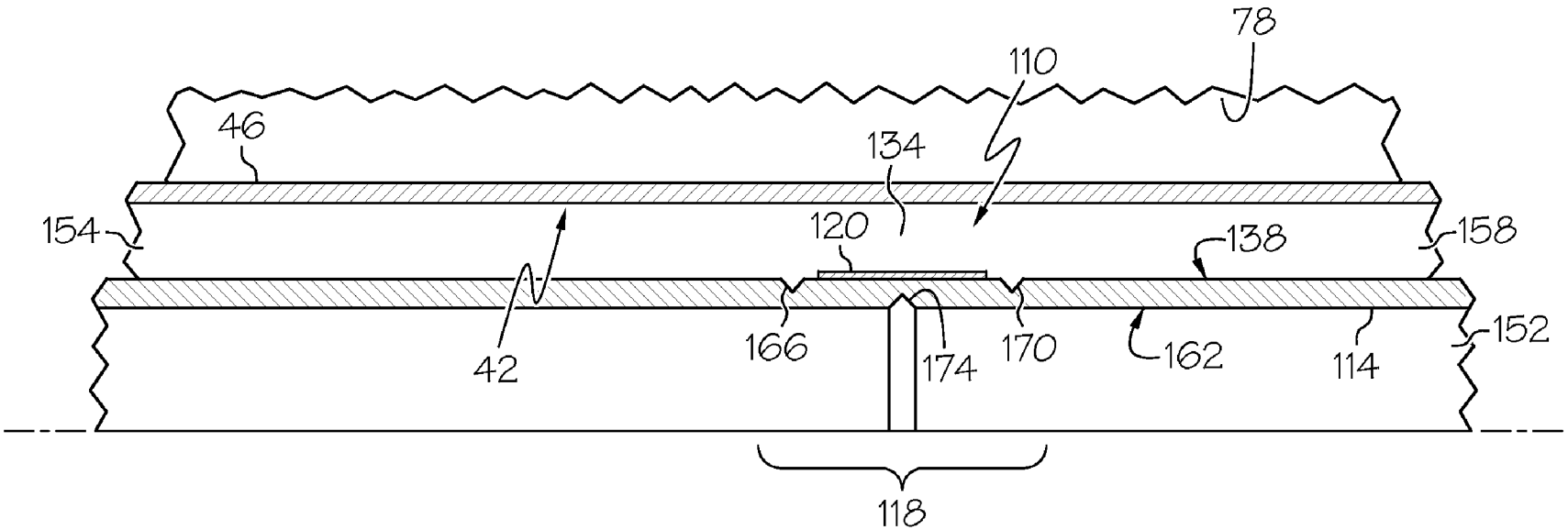
FIG. 4 depicts a partial cross sectional view of another embodiment of a centralizer tool disclosed herein in an unactuated configuration.
Figure 5:
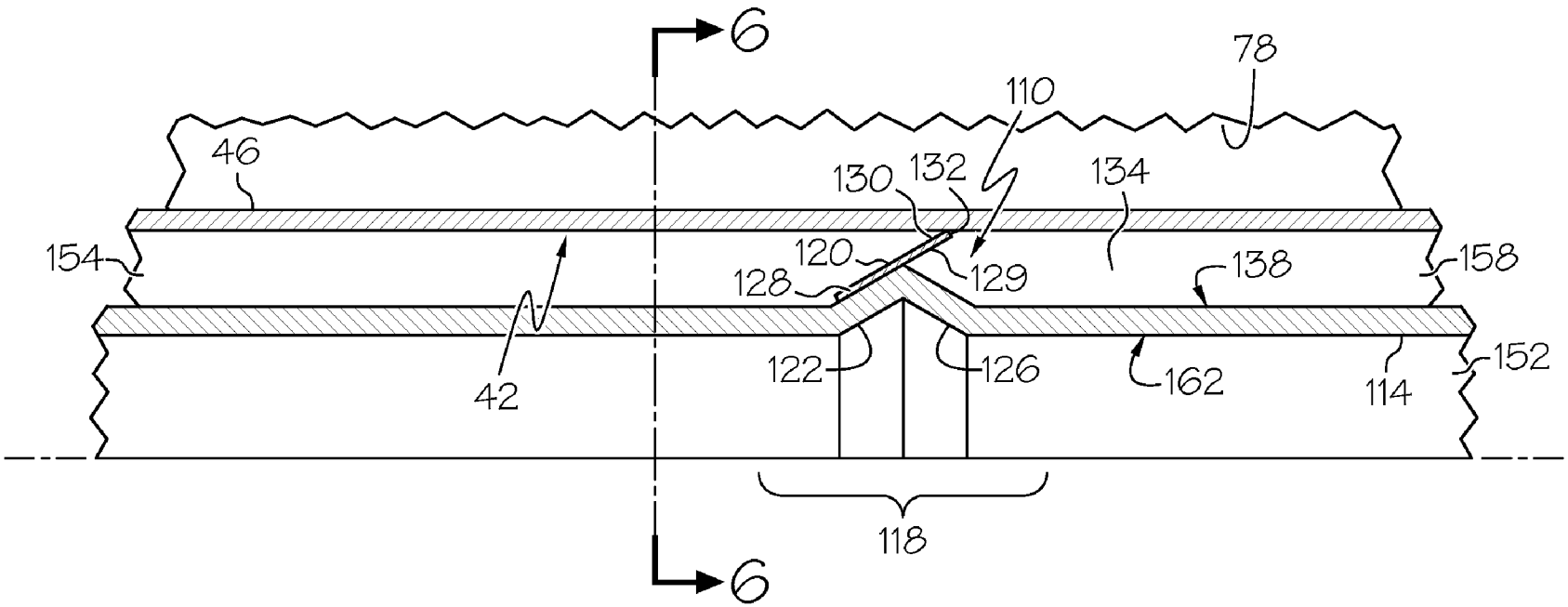
FIG. 5 depicts a partial cross sectional view of the centralizer tool of FIG. 4 in an actuated configuration.

Referring to FIGS. 4 and 5, an alternate exemplary embodiment of the centralizer tool 110 is illustrated. The centralizer 110 includes a tubular member 114 and an actuatable centralizing portion 118. The centralizing portion 118 includes a plurality of extension members 120 attached thereto. As illustrated in FIG. 4 the centralizing portion 118 is in an unactuated configuration and as illustrated in FIG. 5 the centralizing portion 118 is in an actuated configuration. In the actuated configuration the centralizing portion 118 forms two frustoconical sections 122 and 126. The extension members 120 are fixedly attached to the first frustoconical section 122 at a first portion 128. A second portion 129 of the extension members 120 is positioned radially outwardly of the second frustoconical section 126 but is not attached to the second frustoconical section 126. As such when the centralizing portion 118 is actuated the extension members 120 remain substantially parallel to the first frustoconical section 122 causing the second portion 129 of the extension members 120 to extend radially outwardly of the outermost portion of the frustoconical members 122, 126. As such the greatest radial deformation 130 of the centralizer 110 is the end 132 of each of the extension members 120. An annular flow area 134 is defined by the greatest radial deformation 130 and an outside surface 138 of the undeformed tubular member 114. The greatest radial deformation 130 contacts an inner surface 42 of a tubular structure 46 within which the centralizer tool 110 is to be centralized and it is this contact that causes the centralizer tool 110 to become centralized within the tubular structure 46. An axial space 150 between adjacent extension members 120 forms a first fluid passage through which fluid can flow between an uphole annular area 154 and a downhole annular area 158 when the centralizer 110 is in the actuated configuration. A second fluid passage 152 is formed through the center of the tubular member 114 defined by the inside surface 162.

Another operable component (not shown), such as a cutter, for example, can be can be attached to the centralizer tool 110. The cutter can be located either uphole or downhole from the centralizer tool 110, however, the cutter should be located close enough to the centralizer tool 110 that the cutter is centered within the tubular structure 46 by the centralization of the centralizer tool 110. In so doing the centralizer tool 110 locates the cutter central to the tubular structure 46 such that the cutter engages the inner surface 42 substantially simultaneously to prevent detrimental vibrations and interrupted cuts. The centralizing force of the centralizer tool 110 can be controlled by the geometry and materials of the centralizer portion 118 such that noncentering loads encountered will not force the centralizer tool 110 off center.

The tubular member 114 is reconfigurable between the unactuated configuration and the actuated configuration. In the unactuated configuration the frustoconical sections 122 and 126 are configured as cylindrical components having roughly the same inside dimension as the tubular member 114 in the uphole annular area 154 and a downhole annular area 158. Reconfiguration from the unactuated to the actuated configuration is effected, in one embodiment, by the application of an axial compressive load on the tubular member 114. Similarly, reconfiguration from the actuated to the unactuated configuration is effected by the application of an axial tensile load on the tubular member 114.

Reconfigurability of the tubular member 114 between the actuated configuration and the unactuated configuration is due to the construction thereof. The centralizer portion 118 is formed from a section of the tubular member 114 that has three lines of weakness, specifically located both axially of the tubular member 114 and with respect to an inside surface 162 and the outside surface 138 of the tubular member 114. In one embodiment, a first line of weakness 166 and a second line of weakness 170 are defined in this embodiment by diametrical grooves formed in the outside surface 138 of the tubular member 114. A third line of weakness 174 is defined in this embodiment by a diametrical groove formed in the inside surface 162 of the tubular member 114. The three lines of weakness 166, 170 and 174 each encourage local deformation of the tubular member 114 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The three lines of weakness 166, 170 and 174 together encourage deformation of the tubular member 114 in a manner that creates a feature such as the centralizer portion 118. The feature is created, then, upon the application of an axially directed mechanical compression of the tubular member 114 such that the centralizer portion 118 is actuated as the tubular member 114 is compressed to a shorter overall length. Other mechanisms can alternatively be employed to actuate the tubular member 114 between the unactuated relatively cylindrical configuration and the actuated configuration presenting the frustoconical sections 122 and 126. For example, the tubular member 114 may be reconfigured to the actuated configuration by diametrically pressurizing the tubular member 114 about the inside surface 162 in the centralizer portion 118.

Figure 6:
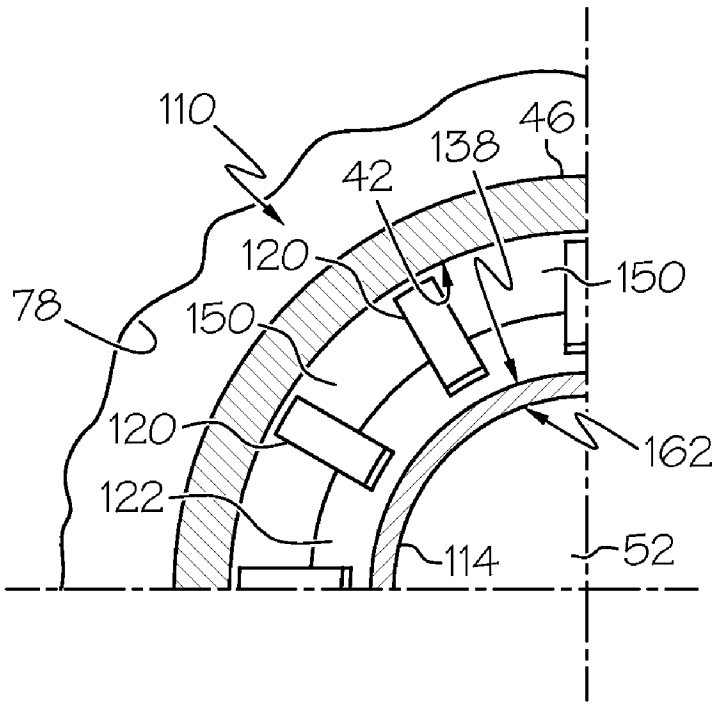
FIG. 6 depicts a partial cross sectional view of the centralizer tool of FIG. 5 taken at arrows 6-6.

Referring to FIG. 6, a cross sectional view of the centralizer tool 110 of FIG. 5 is shown taken at arrows 6-6. The fluid passages between the centralizer tool 110 and the inside surface 42, of the tubular structure 46, created by the axial spaces 150 between the extension members 120, is illustrated. Although the extension members 120 depicted herein are rectangular prisms, it should be noted that alternate embodiments could have extension members of any shape. It should also be noted that in alternate embodiments the centralizer tool 110 could be used to center within an open bore 78 or any other substantially cylindrical structure.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A centralizer comprising:

a deformable tubular member having:

a non-deformable portion with an outside surface defining a reference diameter;

a deformable portion being deformable to a greater radial dimension than the reference diameter, the deformable portion when in the deformed position fluidically isolating at least one first fluid passage having a greater radial dimension than the reference diameter from at least one second fluidic passage having a radial dimension smaller than a radial dimension of the deformable portion, at least a portion of the deformable portion when deformed being contactable with a tubular structure so that the centralizer is centralized by such contact; and a plurality of lines of weakness disposed at the tubular member, at least one of the plurality of lines of weakness being at one of an inside surface and the outside surface and at least one other of the plurality of lines of weakness being at the other of the inside surface and the outside surface, the lines of weakness, upon axial loading of the centralizer causing deformation of the deformable portion and contact of the at least a portion of the deformable portion with the tubular structure.

2. The centralizer as claimed in claim 1 wherein the tubular member further comprises an unactuated configuration and an actuated configuration resulting in centralization when disposed within another tubular structure having an inside dimension bridgeable by the centralizer when actuated.

3. The centralizer as claimed in claim 2 wherein the at least one first fluid passage and the at least one second fluid passage are maintained whether the tubular member is in the actuated configuration or the unactuated configuration.

4. The centralizer as claimed in claim 3 wherein one of the fluid passages is located at a radially outermost perimetrical portion of the centralizer.

5. The centralizer as claimed in claim 3 wherein one of the fluid passages is located at a portion of an annulus, the radial dimensions of the annulus being defined by the reference diameter and the greater radial dimension.

6. The centralizer as claimed in claim 5 wherein the portion of the annulus is axial grooves in the tubular member.

7. The centralizer as claimed in claim 5 further comprising extension members attached to the deformable portion and the portion of the annulus is space between the extension members.

8. The centralizer of claim 2 wherein the actuated configuration comprises an axial shortening of the tubular member and a consequent radial growth of the tubular member centered at at least one of the lines of weakness.

9. The centralizer of claim 2 wherein the centralizer is reconfigurable between the actuated and the unactuated configurations.

10. The centralizer of claim 1 wherein the deformable tubular member is made of metal.

11. The centralizer of claim 1 wherein the plurality of lines of weakness is three or more lines of weakness.

12. A method for centralizing a downhole component comprising:

delivering a tubular member having a plurality of lines of weakness therein to a site requiring a centralizer;

actuating the tubular member;

causing a portion of the tubular member to deform radially from an unactuated position;

contacting a downhole tubular structure with at least a portion of the deformed portion of the tubular member; and maintaining at least two separate fluid passages, a first fluid passage between the portion of the tubular member deformed and an inside surface of the tubular structure and a second fluid passage at a dimension smaller than an outside surface of the portion of the tubular member deformed.

13. The method for centralizing a downhole component of claim 12 wherein the actuating is by axially compressing the tubular member.

14. A method for making a centralizer, comprising:

configuring a deformable tubular member with a plurality of lines of weakness, at least one of the plurality of lines of weakness disposed at each of an inside dimension of the tubular member and an outside dimension of the tubular member;

locating the plurality of lines of weakness relative to each other to facilitate deforming of the tubular member in a desired direction upon actuation;

configuring the centralizer tool such that at least a portion is contactable with a downhole structure to which the centralizer tool is centralizable after actuation of the centralizer tool; and forming at least two fluid passages isolated from one another, a first fluid passage being at a dimension greater than the outside dimension of the deformable tubular member and a second fluid passage being at a dimension smaller than the outside dimension of the deformable tubular member.

15. The method for making a centralizer of claim 14 wherein the configuring further comprises creating the first fluid passage at a portion of the tubular member having a greatest radial displacement relative to an unactuated position of the tubular member.

16. The method for making a centralizer of claim 14 wherein the forming of the first fluid passage further comprises creating axial grooves in the centralizer tool.

17. The method for making a centralizer of claim 14 wherein the forming of the first fluid passage further comprises attaching extension members to the centralizer tool.

18. A downhole centralizer system comprising:

a deformable tubular member having:

a non-deformable portion with an outside surface defining a reference diameter;

a deformable portion being deformable to a greater radial dimension than the reference diameter, the deformable portion when in the deformed position fluicially isolating at least one first fluid passage having a greater radial dimension than the reference diameter from at least one second fluid passage having a radial dimension smaller than a radial dimension of the deformable portion, at least a portion of the deformable portion when deformed being contactable with a tubular structure so that the centralizer is centralized by such contact;

a plurality of lines of weakness disposed at the tubular member, at least one of the plurality of lines of weakness being at one of an inside surface and the outside surface and at least one other of the plurality of lines of weakness being at the other of the inside surface and the outside surface, the lines of weakness, upon axial loading of the centralizer causing deformation of the deformable portion and contact of the at least a portion of the deformable portion with the tubular structure; and at least one additional operable component operably attached to the deformable tubular member, the component having operability facilitated by the deformable tubular member.

19. The downhole centralizer system as claimed in claim 18 wherein the additional operable component is a cutter.

* * * * *